United States Patent [19]

Martzloff et al.

[11] 4,401,912

[45] Aug. 30, 1983

[54] METAL VAPOR ARC LAMP HAVING THERMAL LINK DIMINISHABLE IN HEAT CONDUCTION

[75] Inventors: Francois D. Martzloff, Schenectady; Marshall G. Jones, Scotia, both of N.Y.

[73] Assignee: General Electric Company, Schenectady, N.Y.

[21] Appl. No.: 260,245

[22] Filed: May 4, 1981

[51] Int. Cl.[3] ..... H01J 1/02; H01J 7/24; H01J 61/52

[52] U.S. Cl. ..... 313/17; 313/13; 313/634

[58] Field of Search ..... 313/17, 13, 217

[56] References Cited

U.S. PATENT DOCUMENTS

| | | | |
|---|---|---|---|
| 3,246,189 | 4/1966 | Waymouth | 313/13 |
| 4,034,252 | 7/1977 | McVey | 313/217 |
| 4,074,163 | 2/1978 | van der Leeuw | 313/13 |

*Primary Examiner*—Alfred E. Smith
*Assistant Examiner*—K. Wieder
*Attorney, Agent, or Firm*—Donald R. Campbell; James C. Davis, Jr.; Marvin Snyder

[57] ABSTRACT

A high pressure metal (sodium) vapor lamp comprises an outer vitreous envelope and an inner ceramic arc tube supported within it. The arc tube contains vaporizable metal in excess of the quantity vaporized in operation and the heat balance determines a cold spot whereat excess metal collects. The temperature of the cold spot determines the vapor pressure and the voltage drop across the lamp which must lie between specified limits. A thermal link is provided to a metal member such as the exhaust tube, the heat loss from which influences significantly the temperature of the cold spot. In completed lamps measuring too low in voltage, such thermal link may be partly severed without breaking open the outer envelope in order to raise the voltage. One convenient way utilizes an auxiliary wire which is cut by aiming a laser beam at it. Another convenient way to reduce the conductive cross section of the thermal link is to use a laser to drill one or more holes through a metallic member comprising the thermal link.

14 Claims, 11 Drawing Figures

METAL VAPOR ARC LAMP HAVING THERMAL LINK DIMINISHABLE IN HEAT CONDUCTION

This application is related to allowed copending application Ser. No. 221,839, filed Dec. 31, 1980, J. M. Strok, similarly titled and assigned to the same assignee as the present invention.

The invention relates to metal vapor arc lamps operating with an unvaporized excess of metal, and more particularly to high pressure sodium lamps utilizing an alumina ceramic envelope in which the cold spot temperature determines the vapor pressure within the lamp and the voltage drop across it.

BACKGROUND OF THE INVENTION

The high intensity sodium vapor lamps with which the invention is most useful comprise a slender tubular ceramic arc tube which is generally mounted in an outer vitreous envelope or glass jacket. The arc tube is made of light-transmissive refractory oxide material resistant to sodium at high temperatures, such as suitably high density polycrystalline alumina or synthetic sapphire. The tube contains a discharge supporting filling comprising sodium together with mercury for imporved efficiency, along with a rare gas to facilitate starting. Thermionic electrodes are contained within the tube whose ends are sealed by closure members through which connections are made to the electrodes. The outer envelope which encloses the ceramic arc tube is generally provided at one end with a screw base to which the electrodes of the arc tube are connected.

The high pressure sodium vapor lamp conventionally contains an excess amount of sodium-mercury amalgam; that is, it contains more amalgam than is vaporized when the lamp reaches a stable operating condition. By having an excess, the quantity supplied is made noncritical and some of the excess amalgam is used to replace any lost for instance, by electrolysis through the alumina walls during the life of the lamp as it ages.

The lamp voltage, that is the voltage drop across the arc tube during normal operation, is dependent upon the vapor pressure and the vapor pressure in turn is determined by the lowest temperature in the arc tube which is dependent upon the thermal balance. A preferred lamp design utilizes an externally projecting metal exhaust tube which is sealed off and provides a reservoir for excess sodium mercury amalgam external to the arc tube proper. This arrangement has the advantage of placing the excess amalgam in a location removed from the direct heat of the arc and of the electrodes, so that arc tube blackening as the lamp ages has a minimal effect on sodium vapor pressure and on lamp voltage. Also the use of an external reservoir facilitates close adjustment of the heat balance in the lamp. Another lamp design avoids the need for an exhaust tube because the change of sodium mercury amalgam is inserted into an arc tube closed at one end. Then, while the closed end is cooled, the other end is sealed off in a chamber containing an atmosphere of the insert starting gas intended for the lamp. In such a lamp, the heat balance is planned to make one end or the other the cold spot, and the excess amalgam collects mostly in the corners where the end cap or plug is joined to the ceramic body. In both designs, lamp voltage increases as the lamp ages, and the end of life is reached when the ballast can no longer sustain the arc across the prevailing high voltage drop.

In high pressure sodium lamp manufacture, dimensions of parts, material quality, and processing are carefully controlled in order to maintain lamp voltage within specified limits. Nevertheless, a significant percentage of such lamps produced in the plants of applicants' assignee require rework because the voltage of the finished lamp falls above or below the specified limits. Reworking in order to salvage lamps has heretofore been expensive and time consuming due to the need for breaking the outer envelope or jacket, cutting the ceramic arc tube out from the old stem assembly, welding it to a new stem assembly, and adding or removing exhaust tube radiation shields to correct the heat balance. Alternatively, the heat balance may be modified by grit-blasting the exhaust tube or by painting chrome green paint on it. The reworked arc tube must be sealed into a new outer envelope which must then be evacuated and the lamp must be rebased and reseasoned. The present invention minimizes the amount of rework necessary to salvage lamps.

SUMMARY OF THE INVENTION

In accordance with the invention, arc discharge lamps are provided with a thermal link joined to a metal member which forms part of the arc tube or is attached to the arc tube, and the heat loss from this member influences significantly the temperature of the cold spot. In a lamp having an external metal exhaust tube serving as reservoir, the link is most conveniently made to the exhaust tube. The thermal link is fabricated such that its heat conduction may be readily diminished in the completed lamp without breaking open the lamp jacket. Preferably, heat conduction through the link lowers the mean of the lamp voltage distribution sufficiently to reduce to a negligible value the percentage of high voltage lamps manufactured. The lamp production then consists almost entirely of lamps whose voltage is within predetermined limits, and a larger percentage than previously of lamps whose voltage is below the lower specified limit. The low voltage lamps are then adjusted upward in voltage by reducing the heat conduction of the thermal link.

In one preferred embodiment, the thermal link comprises a main part and a severable auxiliary part in the form of a wire extending from the exhaust tube to the metal frame of the mount assembly. The wire of the auxiliary part may be finer or may be longer than that of the main part in order to have lesser heat conduction. In low voltage lamps, the auxiliary wire is conveniently severed without breaking the outer envelope by cutting the wire with a laser beam aimed through the glass of the outer envelope. Another way of severing the auxiliary wire is to inlcude a portion in it which melts at a lower temperature and to heat it to that temperature by coupling high frequency currents into it.

In another preferred embodiment, the thermal link comprises a metallic ribbon or a deformed wire extending from the exhaust tube to the metal frame of the mount assembly. In low voltage lamps, one or more holes may be punctured in the selected ribbon or wire site by a laser beam to thereby reduce the conductive cross section of the thermal link and raise the lamp voltage.

One object is to provide an arc discharge lamp having a characteristic voltage which may be changed without opening the lamp outer envelope.

Another object of the invention is to reduce the rework procedures needed in arc discharge lamp manufacturing by providing a way of increasing lamp characteristic voltage without opening the lamp outer envelope.

Another object of the invention is to provide a method of increasing lamp characteristic voltage in which the cross section of a thermal link member is reduced by using a laser to drill one or more holes therein.

BRIEF DESCRIPTION OF THE DRAWINGS

The features of the invention believed to be novel are set forth with particularity in the appended claims. The invention itself, however, both as to its organization and method of operation, together with further objects and advantages thereof, may best be understood by reference to the following description taken in conjunction with the accompanying drawings in which:

DETAILED DESCRIPTION OF THE INVENTION

Figure 1:
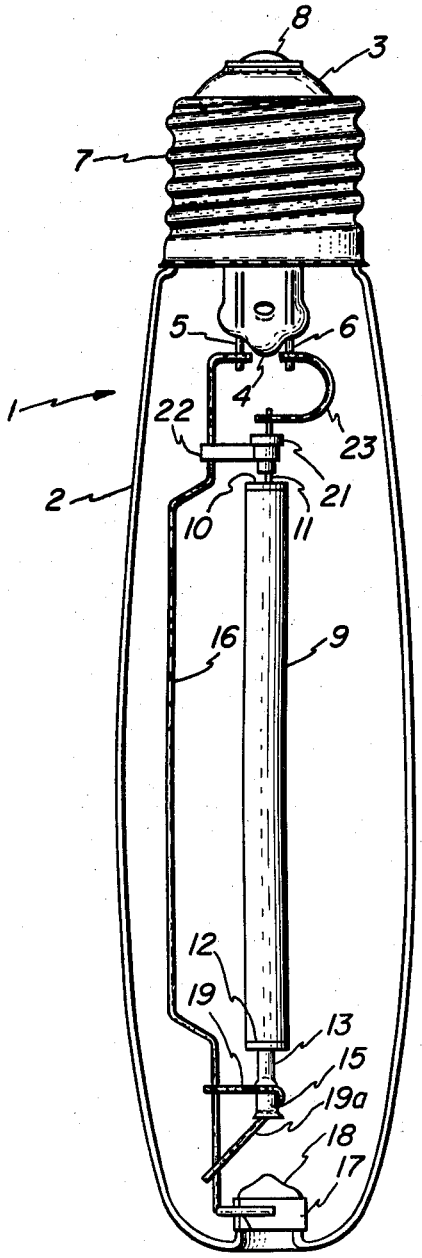
FIG. 1 is a view of a high pressure sodium vapor lamp containing an auxiliary thermal link.

A high pressure sodium vapor lamp 1 embodying the invention is illustrated in FIG. 1. The lamp comprises a vitreous outer envelope 2 with a standard mogul screw base 3 attached to the stem end which is shown uppermost. A re-entrant stem press 4 has a pair of realtively heavy lead-in conductors 5, 6 extending through it whose outer ends are connected to the screw shell 7 and eyelet 8 of the base.

The inner envelope or arc tube 9 centrally located within the outer envelope comprises a length of light-transmitting ceramic tubing, suitably polycrystalline alumina ceramic which is translucent, or singly crystal alumina which is clear and transparent. The upper end of the arc tube is closed by an alumina ceramic plug 10 through which extends hermetically a niobium inlead wire 11 which supports the upper electrode. The lower end closure also comprises a ceramic plug 12 through which extends a thin-walled niobium exhaust tube 13 which serves as an exhaust and fill tubulation during manufacture of the lamp, and as support and current inlead for the lower electrode. In the finished lamp, exhaust tube 13 forms an external reservoir for excess sodium mercury amalgam. The ceramic plugs are sealed to the ends of the tube, and the niobium conductors 11 and 13 are sealed through the plugs, by means of a glassy sealing composition comprising primarily alumina and calcia which is fused in place.

Figure 1A:
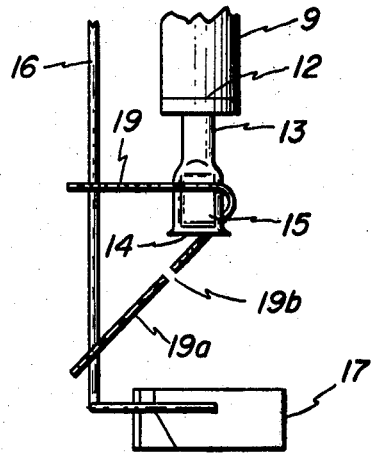
FIG. 1*a* is an enlarged view of a fragment of FIG. 1 showing the auxiliary link thereof severed.

Electrodes of conventional construction (not shown), suitably close-wound coils of tungsten wire activated by dibarium calcium tungstate retained in the interstices between turns, are provided in opposite ends of the arc tube and supported from inleads 11 and 13. Reference may be made to U.S. Pat. No. 3,708,710, Smyser et al, for a detailed description of suitable electrodes. By way of example, the illustrated lamp is a 400 watt size and the arc tube is 112 millimeters long by 7 millimeters in bore. The fill comprises a charge of 25 milligrams of amalgam of 25 weight percent sodium and 75 weight percent mercury, together with xenon at a pressure of 20 torr serving as a starting gas. The illustrated exhaust tube 13 is pinched off and hermetically sealed at the end 14, as shown in FIG. 1*a*, and has a flattened end portion 15 of sufficient volume to accommodate the excess amalgam. Such a flattened end portion is useful for a universal burning lamp subject to shock or vibration as disclosed in copending application Ser. No. 135,953,, filed March 31, 1980, J. M. Sheok, now U.S. Pat. No. 4,342,938 entitled "Universal Burning Ceramic Lamp" and assigned to the same assignee as this invention.

The arc tube is mounted within the outer envelope in a manner to allow for differential thermal expansion. A sturdy support rod 16 which extends substantially the length of the outer envelope is welded to lead-in conductor 5 at the stem end and braced by spring clamp 17 engaging nipple 18 in the dome end of the outer envelope. The arc tube is supported primarily by wire conductor 19 which is welded across from niobium tube 13 to support rod 16. At the upper end, axial lead wire 11 extends through an insulating bushing 21 which is supported from rod 16 by means of metal strap 22. The aperture through the bushing allows free axial movement of inlead 11 and a flexible conductor 23 makes the electrical connection from the inlead to lead-in conductor 6. Differential thermal expansion of the alumina arc tube relative to the mounting is accommodated by axial movement of inlead wire 11 through bushing 21 and by flexing of curved conductor 23.

One may consider a thermal link extending from exhaust tube 13 to support rod 16 which comprises a main part and a severable auxiliary part. When the thermal conductance of the auxiliary part is small relative to that of the main part, a reasonable first approximation for the effect of severing the auxiliary part is that the change in lamp operating voltage is proportional to the thermal conductance C of the auxiliary part, which is given by:

$$C = K \cdot (A/L),$$

where

K = effective thermal conductivity of part,

A = cross-sectional area of part, and

L = length of part.

Figure 3:
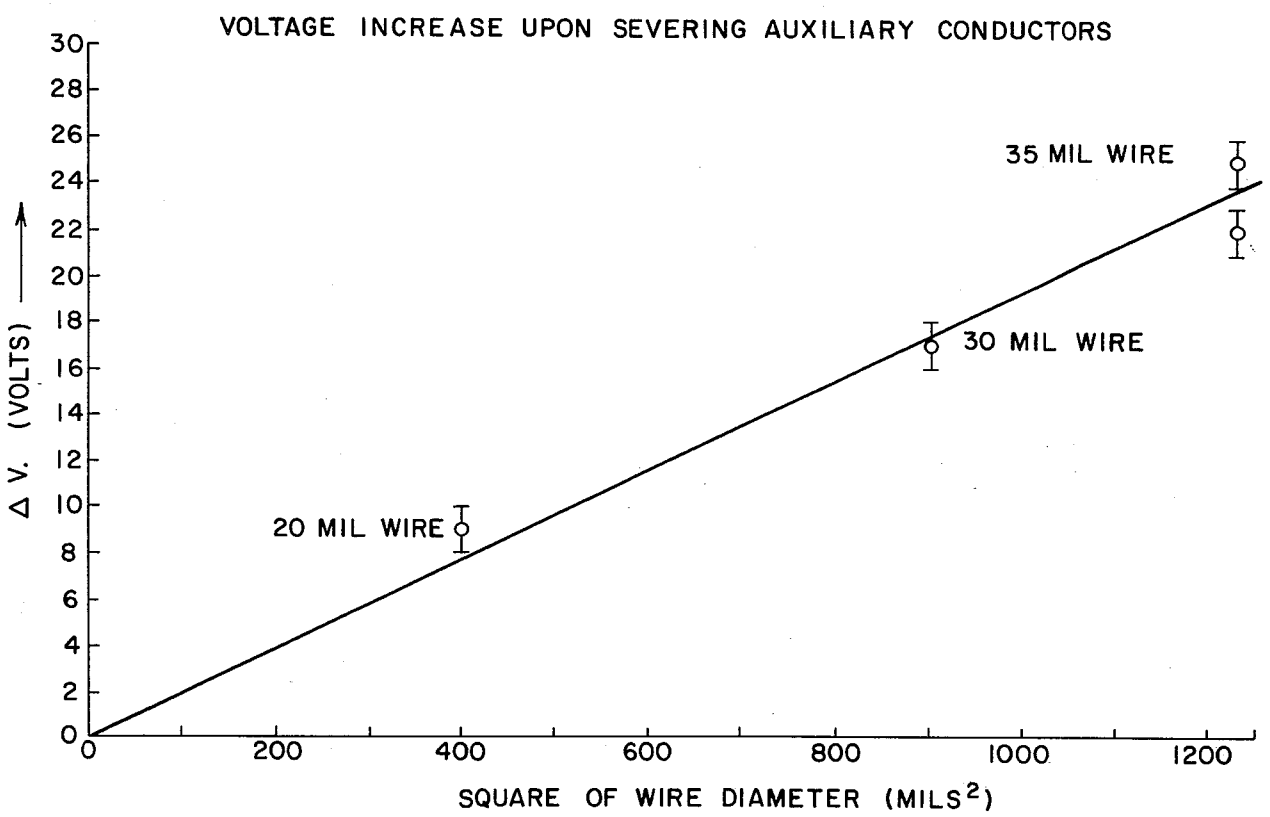
FIG. 3 is a plot of experimental data indicating the relationship between lamp voltage rise and the square of the diameter of the auxiliary severable thermal link in a lamp similar to that shown in FIG. 1.

Tests have been conducted on lamps in which the thermal link comprised a main part of 35 mil niobium wire and an auxiliary part. FIG. 3 shows the effect on lamp voltage of severing the auxiliary conductor consisting of 20 mil, 30 mil, or 35 mil niobium wire. It will be observed that the voltage rise is substantially linear with respect to the square of wire diameter. Either wire diameter or length may be varied to control the voltage rise occurring when the part is severed.

The thermal link shown in FIG. 1 between exhaust tube 13 and support rod 16 determines an embodiment of the invention which is preferred from the point of view of facile automated manufacture. A niobium wire 19, suitably of 35 mil diameter, is spot welded to support rod 16 and extends to niobium exhaust tube 13 to which it is spot welded on the flattened portion 15. At a point beyond the spot weld, the niobium wire is bent back to provide a longer portion 19*a* which is spot welded to support rod 16 at a point appreciably removed from the first spot weld. This arrangement allows the use of a single wire size and provides a thermal link in which the main part 19 is relatively short and the auxiliary part 19*a* has a lower conductance because it is considerably longer.

In a manufacturing process utilizing the invention, all lamps are made as illustrated in FIG. 1. The completed lamps are then briefly seasoned and tested for voltage. The lamps whose voltage falls below the lower specification limit are segregated and subjected to a laser pulse focused on the wire link 19*a* to sever it. It has been found that a pulsed neodymium laser of 20 Joules rating with an output wavelength of 1.06 micron is adequate to sever the wire when focused on it through the outer envelope. It is desirable to use niobium or refractory metal having a low vapor pressure at the cutting temperature in order to avoid depositing a heat and light-reflecting film on the inside of the envelope 2. Niobium melts at 2468° C. and when it is cut by the laser, tiny fragments are spat out or stick to the cut ends but no objectionable film is deposited anywhere.

Figure 2:
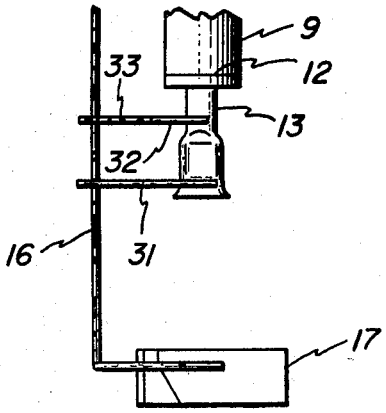
FIG. 2 is a view of a portion of a lamp similar to that shown in FIG. 1, wherein the thermal links form a square loop to facilitate electromagnetic coupling of energy.

There are other ways of opening the auxiliary part of the thermal link than through the use of a laser. Referring to FIG. 2, the thermal link between exhaust tube 13 and support rod 16 comprises a main part 31 consisting of 35 mil niobium wire and an auxiliary part which completes a square loop. The auxiliary part consists of 15 mil wire of which the portion 32 spot-welded to the exhaust tube is niobium, and the portion 33 welded to the support wire is another metal with lower melting point and low vapor pressure at its melting point, suitably aluminum. The two portions have been joined together by ultrasonic welding. With this embodiment, in order to open the auxiliary part of the thermal link after the lamp has been completed, a radio-frequency current is coupled into the rectangular loop formed by the two portions of the thermal link, the exhaust tube, and the support rod. The current generates heat and since aluminum wire portion 33 has the least cross section and a lower melting temperature (669° C.), it melts and opens the auxiliary portion of the link. An alternative method of accomplishing the same objective is to focus a heat lamp on the low melting temperature portion 33 of the link.

Figure 4:
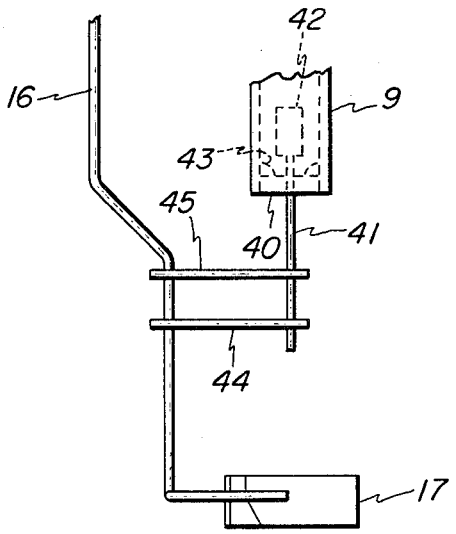
FIG. 4 is a view of a portion of a double wire arc tube embodying the invention.

In the variant of the invention illustrated in FIG. 4, the lower end of the arc tube 9 is closed by a ceramic plug 40 through which extends hermetically a niobium inlead wire 41 supporting an electrode 42 shown in dotted lines. The wire seal may be similar to that at the upper end of the arc tube shown in FIG. 1. In such a lamp which has no exhaust tube and is symmetrical end for end, an amalgam charge is inserted into the arc tube prior to sealing the second end closure. The lower end of the arc tube is cooled and the seal is made in a chamber containing an atmosphere of the inert starting gas, such as xenon, intended for the lamp. A process suitable for making a lamp in this way is described in U.S. Pat. No. 3,609,437, Tol et al. The details of the wire seals themselves, however, are preferably in accordance with U.S. Pat. No. 3,992,642, McVey et al, which provides some thermal isolation of the lead wire seal from the electrode by means of a loop in the conductor between the electrode and the seal region. In such a lamp, the excess sodium-mercury amalgam collects, for the most part, in the corners 43 where the plug is joined to the ceramic body at the lower end of the arc tube. The thermal link from lead wire 41 to frame support rod 16 comprises heavier niobium wire 44 and lighter serverable auxiliary niobium wire 45. The auxiliary wire 45 may be laser cut when needed in the finished lamp.

Figure 5:
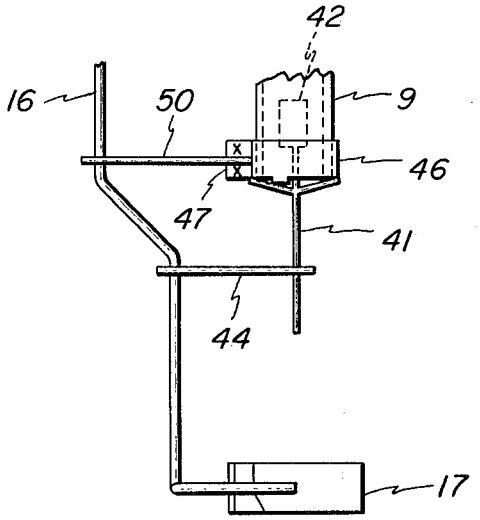
FIG. 5 is a view of a portion of another double wire arc tube embodying the invention in a link to a heat shield.

The variant of the invention shown in FIG. 5 has wire seals at both ends of the arc tube as in FIG. 4. The illustrated design is particularly suitable for smaller sizes of lamps, for instance, 100 watts or less, wherein a heat shield may be provided at each end of the arc tube in order to achieve a sufficiently high cold spot temperature together with the needed heat balance. The heat shield at the lower end is illustrated in the drawing and comprises a metal reflector band 46, suitably of niobium, wrapped around the ceramic tube 9 with the ends spot-welded together and forming a radial tab 47 on the side next to the support rod 16. The shield may be retained in place by a wire cross-piece welded to inlead wire 41 and by bent-over tabs which together prevent any movement. Reference may be made to U.S. Pat. No. 4,034,252, McVey, for further details on such construction. In accordance with the present invention, a severable thermal link is provided to heat shield 46 in the form of a wire 50 attached to support rod 16 at one end and to tab 47 at the other. For those finished lamps which test low in voltage, thermal link 50 may be laser-severed to give an increment in voltage.

Figure 6:
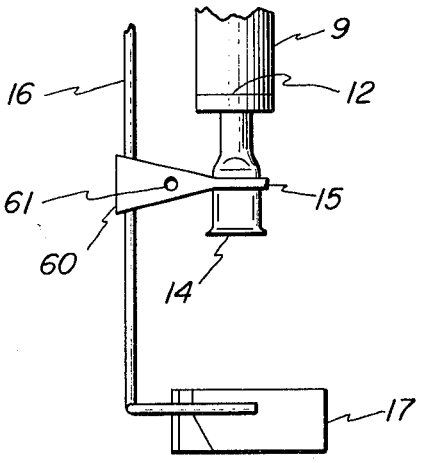
FIG. 6 is a view of a portion of a high pressure sodium lamp similar to that of FIG. 1, showing a thermal link comprising a flat, triangular metallic ribbon.

Rather than employing a severable auxiliary part to reduce the thermally conductive cross section of the thermal link to provide a single discrete voltge increment, the cross section of the thermal link can be selectively and continuously reduced by using a laser to drill holes in the thermal link member without severing it. FIG. 6 illustrates one configuration of this embodiment. A flat triangular ribbon 60, conveniently niobium, replaces main part 19 and auxiliary part 19*a* (FIG. 1) of the thermal link. If it is necessary to adjust lamp voltage, one or more holes 61 may be laser-drilled in the ribbon. Hole diameter and position on the ribbon determine the amount of decrease in the conductive cross section of the thermal link. It should be noted that the ribbon need not be restricted to a triangular geometry and may assume any convenient configuration.

Figure 7A:
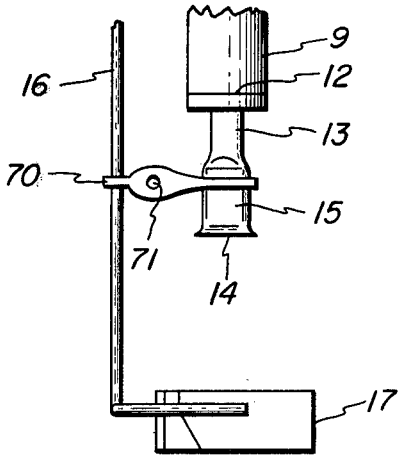
FIG. 7*a* is a view of a portion of another embodiment of a lamp similar to that shown in FIG. 1 wherein a thermal link comprises a tapered wire formed by deforming a cylindrical support wire.
Figure 7B:
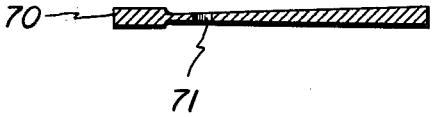
FIG. 7*b* is a section view of the tapered wire shown in FIG. 7*a;*

Another configuration of the latter embodiment is illustrated in FIG. 7*a*, wherein the thermal link may be a tapered niobium wire 70 formed by deforming main support wire 19 (FIG. 1) to form a gradual diminution in wire thickness. The thermal conductivity of wire 70 is initially equivalent to that of wire 19 (FIG. 1). However, the lamp voltage can be controllably raised by drilling one or more holes 71 (which may be of uniform diameter) in the deformed region of the wire. Depending on the axial position of hole 71 along wire 70, and nearly independently of the lateral position of the hole, a controllable percentage of the cross section available for conducting heat is removed. FIG. 7*b* depicts wire 70 when viewed in its narrowest dimension.

Figure 8:
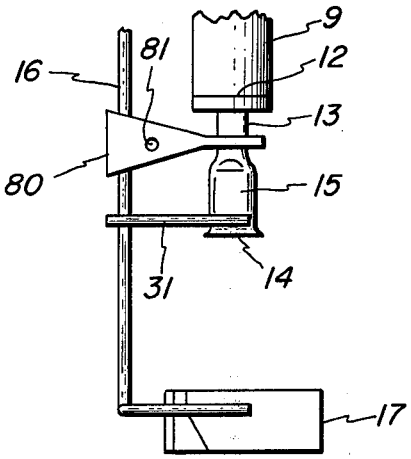
FIG. 8 is a view of a portion of another embodiment of a lamp similar to that shown in FIG. 1 wherein a thermal link comprises a main part and an auxiliary part constituting a flat, triangular metallic conductor.
Figure 9:
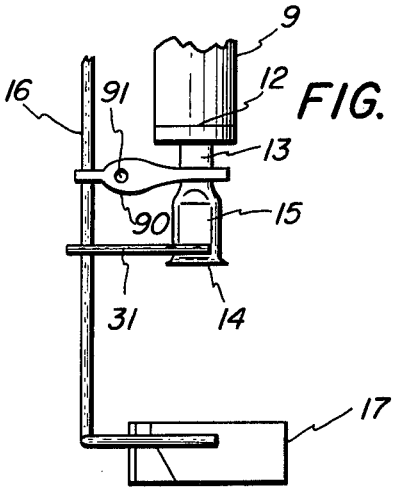
FIG. 9 is a view illustrating a thermal link similar to that shown in FIG. 8, but wherein the auxiliary part comprises a deformed cylindrical support wire.

Alternatively, the auxiliary thermal link made up of portions 33 and 34 (FIG. 2) or 19*a* (FIG. 1) may be replaced by a flat metallic ribbon, such as triangular ribbon 80 shown in FIG. 8, or a deformed wire 90 shown in FIG. 9. Lamp voltage, as required, may be continuously increased by forming one or more holes 81 and 91, FIGS. 8 and 9, respectively, in auxiliary thermal link parts 80 and 90, respectively.

It should be noted that holes 61, 71, 81, and 91 (FIGS. 6, 7*a*, 8, and 9, respectively) need not be circular. In fact, it may be particularly advantageous to shape the laser beam with a cylindrical lens, for example, to drill slit-like holes, thereby minimizing the quantity of material vaporized within the lamp outer envelope.

From the foregoing it may be appreciated that the present invention provides an arc discharge lamp having a characteristic voltage which may be changed without opering the lamp outer envelope. In accordance with the invention, the lamp characteristic voltage may be increased by reducing the heat conductive cross section of a thermal link member by using a laser to drill one or more holes therein. In this manner, rework producures of lamps whose voltage is below the lower specified limit are reduced.

While certain preferred features of the invention have been shown by way of illustration, many modifications and changes will occur to those skilled in the art. It is, therefore, to be understood that the appended claims are intended to cover all such modifications and changes as fall within the true spirit of the invention.

The invention claimed is:

1. An arc discharge lamp comprising:

an outer vitreous envelope;

a pair of lead-in conductors sealed into said envelope;

an arc tube supported within said outer envelope and connected to said lead-in conductors;

an ionizable medium sealed within said arc tube and including vaporizable metal in a quantity exceeding that vaporized during operation, the heat balance in said lamp determining a cold spot in said arc tube whereat excess metal collects, and the temperature of said cold spot determining the metal vapor pressure in said arc tube and the voltage drop across said arc tube;

a metal member in said lamp, the heat loss from which influences significantly the temperature of said cold spot; and a thermal link to said metal member, said thermal link having at least one hole formed therein such that the heat conductive cross section thereof in the region of said hole is decreased to a value greater than zero, said hole being formed in order to increase said voltage drop in the completed lamp without breaking open said envelope.

2. The lamp of claim 1 wherein said metal member comprises a sealed-off exhaust tube and the thermal link is made to said exhaust tube.

3. The lamp of claim 2 wherein said thermal link comprises a metal conductor extending from said exhaust tube to a metal frame member providing support for said inner envelope within said outer envelope.

4. The lamp of claim 3 wherein said thermal link comprises a flat metal conductor ribbon.

5. The lamp of claim 3 wheren said thermal link comprises a flat, triangular metal conductor ribbon.

6. The lamp of claim 3 wherein said thermal link comprises a cylindrical metal conductor deformed into a taper.

7. The lamp of any of claims 3, 4, 5, or 6 wherein said ionizable medium comprises sodium-mercury amalgam sealed within said inner envelope.

8. The lamp of claim 1 in which said thermal link comprises a main part and an auxiliary part, said auxiliary part having at least one hole formed therein such that the heat conductive cross section thereof in the region of said hole is decreased to a value greater than zero, said hole in said auxiliary part being formed in order to increase said voltage drop in the completed lamp without breaking open said outer envelope.

9. The lamp of claim 8 wherein said metal comprises a sealed-off exhaust tube and the thermal link is made to said exhaust tube.

10. The lamp of claim 9 wherein said thermal link comprises main and auxiliary metal conductors extending from said exhaust tube to a metal frame member providing support for said inner envelope within said outer envelope.

11. The lamp of claim 10 wherein said auxiliary part comprises a flat metal conductor ribbon.

12. The lamp of claim 10 wherein said thermal link comprises a flat, triangular, metal conductor ribbon.

13. The lamp of claim 10 wherein said thermal link comprises a tapered cylindrical metal conductor deformed into a taper.

14. The lamp of any of claims 10, 11, 12, or 13 wherein said ionizable medium comprises sodium-mercury amalgam sealed within said inner envelope.

* * * * *